US011149522B2

(12) United States Patent
Brandsdal et al.

(10) Patent No.: US 11,149,522 B2
(45) Date of Patent: Oct. 19, 2021

(54) PLUGGING DEVICE

(71) Applicant: Nine Downhole Technologies, LLC, Houston, TX (US)

(72) Inventors: Viggo Brandsdal, Ytre Arna (NO); Geir Valestrand Aasheim, Ytre Arna (NO)

(73) Assignee: Nine Downhole Technologies, LLC, Houston, TX (US)

( * ) Notice: Subject to any disclaimer, the term of this patent is extended or adjusted under 35 U.S.C. 154(b) by 0 days.

(21) Appl. No.: 16/796,769

(22) Filed: Feb. 20, 2020

(65) Prior Publication Data

US 2021/0262316 A1 Aug. 26, 2021

(51) Int. Cl.
*E21B 34/06* (2006.01)
*E21B 33/12* (2006.01)

(52) U.S. Cl.
CPC ..... *E21B 34/063* (2013.01); *E21B 33/1208* (2013.01)

(58) Field of Classification Search
CPC .. E21B 34/063; E21B 33/134; E21B 2200/06; E21B 33/1208; F16K 17/40
See application file for complete search history.

(56) References Cited

U.S. PATENT DOCUMENTS

| | | | | |
|---|---|---|---|---|
| 9,732,579 | B2 | 8/2017 | Hiorth et al. | |
| 2014/0008085 | A1* | 1/2014 | Tinnen | E21B 29/00 166/387 |
| 2016/0060998 | A1* | 3/2016 | Hiorth | E21B 33/12 166/192 |
| 2017/0022783 | A1* | 1/2017 | Yong | E21B 34/063 |
| 2018/0245421 | A1 | 8/2018 | Brandsdal | |

* cited by examiner

*Primary Examiner* — James G Sayre
(74) *Attorney, Agent, or Firm* — Vinson & Elkins L.L.P.

(57) ABSTRACT

A barrier plug assembly for sealing a subterranean wellbore arranged inside a tubing, the barrier plug assembly comprising: at least one frangible barrier element stacked on a carrier ring; a locking sleeve arranged above the carrier ring and located in a closed fluid chamber; a valve arranged on the closed fluid chamber and in pressure communication with the tubing, the valve configured or allowing or preventing pressure communication in between the tubing and the fluid chamber; a retaining device configured for locking the a carrier ring in place; a crushing element arranged a distance below the one frangible barrier element and configured for crushing the at least one frangible barrier element.

21 Claims, 7 Drawing Sheets

PLUGGING DEVICE

The present invention relates to a holding and crushing device for a plugging device in hydrocarbon wells, the plug comprising a barrier material of frangible material.

BACKGROUND

Existing harrier plugs and similar devices are brought into an open state by a mechanical or hydraulic translation of an activation signal and/or three from the upper side of the plug to the lower side of the plug. This mechanical or hydraulic translation takes place though a channel or bore that bypasses the sealing devices of the plug. Such configurations comprise many parts and potential points of Ware, in the form of sleeves, seals, rings etc. Also, configurations based on bypass channels and bores are inherently vulnerable, since they provide potential paths of fluid loss, pressure drops, and other forms of leakage, hi addition, such complicated and vulnerable plug arrangements are dependent on tight tolerances and movement of several parts.

In order to reduce or eliminate the above mentioned disadvantages of known techniques, there is a need for an improved plug arrangement comprising a frangible barrier material. Particularly, there is a need for a plug arrangement comprising an improved actuation mechanism for bringing the plug arrangement into an open state. While some embodiments of the present invention are applicable to barrier plugs, the same mechanisms described herein are also useful in other applications in hydrocarbon wells where a plugging device is needed to separate two regions.

It is an objective of the present invention to meet this need and to provide further advantages over the state of the art.

SUMMARY

It is an object of the present invention to mitigate, alleviate or eliminate one or more of the above-identified deficiencies and disadvantages in the prior art and solve at least the above mentioned problems.

Aspects of the present invention relate to a disappearing barrier plug assembly for sealing a subterranean wellbore, the disappearing barrier plug assembly comprising: a tubular housing having a topside end and a down-hole end, and having a fluid passageway therethrough; a frangible barrier element disposed in the fluid passageway, such that fluid cannot flow through the fluid passageway while the frangible harrier element is disposed in the fluid passageway, the frangible barrier element disposed on a carrier ring, and comprised of a material that, when subjected to a concentrated force, will break; a locking sleeve arranged above the carrier ring in the direction of the topside end of the tubular housing, and located in a closed fluid chamber; and a retaining device configured to lock the carrier ring in place.

In some embodiments, the barrier plug further comprises a valve arranged on the closed fluid chamber and in pressure communication with the topside pressure, the valve configured to allow or prevent pressure communication between a topside pressure and the fluid chamber. In some embodiments, the valve is in fluid communication with the fluid passageway and the fluid chamber. In some embodiments, the valve comprises a burst disk. In some embodiments, the barrier plug further comprises a crushing element arranged a distance from the frangible barrier element and configured for crushing the at least one frangible barrier element. In some embodiments, the crushing element is arranged a distance in a downhole direction from the frangible barrier element. In some embodiments, one or more first sealing elements are arranged on an outer surface of the disappearing bather plug assembly for sealing an annulus defined between the barrier plug assembly and a tubular enclosure in which the barrier plug is placed. In some embodiments, one or more second sealing elements defines the closed fluid chamber. In some embodiments, the locking sleeve comprises a first cavity for receiving an element of the retaining device. In some embodiments, the carrier ring comprises a second cavity for receiving an element of the retaining device, wherein the second cavity has a volume greater than the first cavity. In some embodiments, the retaining device is arranged inside the second cavity.

Aspects of the present invention also relate to a disappearing barrier plug assembly for sealing a subterranean wellbore, the disappearing barrier plug assembly comprising: at least one frangible barrier element stacked on an axially moveable carrier ring prevented from moving by a retaining device arranged in a first cavity defined by the carrier ring; an axially moveable locking sleeve arranged above the carrier ring and located inside a closed fluid chamber comprising a valve having a predetermined opening pressure that when exceeded the valve allows pressure from tubing into the fluid chamber, wherein the locking sleeve comprises a second cavity that, when aligned with the first cavity, the retaining device is released from the second cavity whereby the axially moveable carrier ring and the at least one frangible barrier element are permitted to move towards a crushing element arranged below the one frangible harder element and configured to disintegrate the at least one frangible barrier element.

In some embodiments, the one or more first sealing elements arranged on an outer surface of the disappearing barrier plug assembly for sealing an annulus defined between the disappearing barrier plug assembly and the tubing. In some embodiments, one or more second sealing elements defines the fluid chamber. In some embodiments, the axially moveable locking sleeve is a piston.

Aspects of the present invention also relate to a method for opening a disappearing barrier plug assembly for sealing a subterranean wellbore, the method comprising: providing a disappearing barrier plug assembly comprising a tubular housing having a topside end and a down-hole end, and having a fluid passageway therethrough; a frangible barrier element disposed in the fluid passageway, such that fluid cannot flow through the fluid passageway while the frangible harrier element is disposed in the fluid passageway, the frangible barrier element disposed on a carrier ring, and comprised of a material that, when subjected to a concentrated force, will break; a locking sleeve arranged above the carrier ring in the direction of the topside end of the tubular housing, and located in a closed fluid chamber; and a retaining device configured to lock the carrier ring in place, creating an opening in the closed fluid chamber, applying a topside pressure to the tubular housing that passes into the closed fluid chamber, moving the locking sleeve into an open position that releases the retaining device, causing the frangible barrier element to move.

In some embodiments, the step of applying a topside pressure comprises opening a valve arranged on the closed fluid chamber and in pressure communication with the tubing, the valve configured to allow or prevent pressure communication between the tubing and the fluid chamber. In some embodiments, the method further comprises the step of causing the frangible barrier element to contact a crushing element thereby breaking the frangible barrier element. In some embodiments, the locking sleeve comprises a first cavity which contains an element of the retaining device. In some embodiments, releasing the retaining device further comprises moving an element of the retaining device from the first cavity in the locking sleeve to a second cavity in the carrier ring.

The present invention will become apparent from the detailed description given below.

BRIEF DESCRIPTION OF THE FIGURES

Included in the present specification are figures which illustrate various embodiments of the present disclosed technology. As will be recognized by a person of ordinary skill in the art, actual embodiments of the disclosed technology need not incorporate each and every component illustrated, but may omit components, add additional components, or change the general order and placement of components. Reference will now be made to the accompanying figures and flow diagrams, which are not necessarily drawn to scale, where like numerals denote common features between the drawings, and wherein.

DETAILED DESCRIPTION

Figure 1:
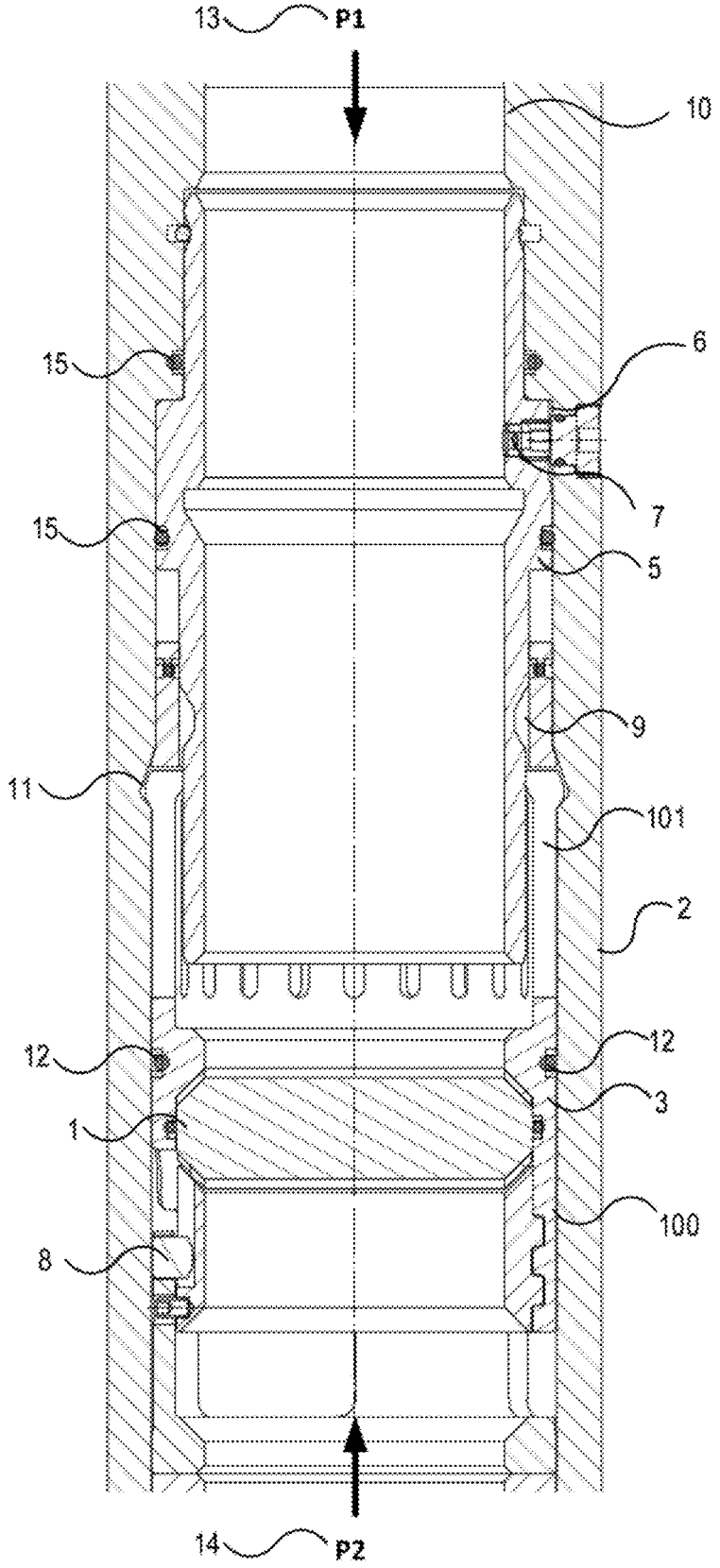
FIG. 1 shows a section view of a barrier plug having a split fingers locking device in accordance with the disclosure in a closed and locked state.

The present invention will now be described with reference to the accompanying drawings, in which preferred example embodiments of the invention are shown. The invention may, however, be embodied in other forms and should not be construed as limited to the herein disclosed embodiments. The disclosed embodiments are provided to fully convey the scope of the invention to the skilled person. Although example embodiments of the present disclosure are explained in detail, it is to be understood that other embodiments are contemplated. Accordingly, it is not intended that the present disclosure be limited in its scope to the details of construction and arrangement of components set forth in the following description or illustrated in the drawings, The present disclosure is capable of other embodiments and of being practiced or carried out in various ways.

It must also be noted that, as used in the specification and the appended claims, the singular forms "a," "an" and "the" include plural referents unless the context clearly dictates otherwise. Moreover, titles or subtitles may be used in this specification for the convenience of a reader, which have no influence on the scope of the present disclosure.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose.

In the following detailed description, references are made to the accompanying drawings that form a part hereof and that show, by way of illustration, specific embodiments or examples. In referring to the drawings, like numerals represent like elements throughout the several figures.

While the preferred embodiment to the invention has been described, it will be understood that those skilled in the art, both now and in the future, may make various improvements and enhancements which fail within the scope of the claims which follow. These claims should be construed to maintain the proper protection for the invention first described.

FIG. 1 illustrates a harrier plug assembly 100 in accordance with an embodiment. Barrier plug assembly 100 can be arranged inside a housing 10 in a tubing 2. The barrier plug assembly 100 can comprise at least one barrier element 1 that may be stacked onto a moveable carrier ring 3. In some embodiments, barrier element 1 can comprise glass. In other embodiments, barrier element 1 can comprise other frangible materials, such as ceramic, hard polymer, or other material that can break (e.g., fracture or shatter) when a concentrated force is applied. In some embodiments, the moveable carrier ring 3 can be locked in place by means of a retaining device 101 and a locking sleeve 5. In some embodiments, the locking sleeve 5 can comprise a first cavity 9. In some embodiments, the retaining device 101 may be arranged inside a second cavity 11 located on the carrier ring 3. In some embodiments, the barrier plug assembly 100 can further comprise a fluid chamber 6 and a valve 7 configured for allowing or preventing pressure communication in between the tubing 10 and the fluid chamber 6. In some embodiments, the valve 7 can be located on the outside of tubing 2 and in fluid communication with fluid in the annulus between the tubing and the wellbore wall, and configured for allowing or preventing pressure communication between the annulus and the fluid chamber 6. In some embodiments, the carrier ring 3 and/or locking ring 5 can be secured to each other or the tubing 2 using a shear rings, balls, spheres, locking dogs, shear pins, and/or c-clips.

In some embodiments, the barrier plug assembly 100 can comprise a breaking, crushing, or shattering element 8 configured for crushing the at least one frangible barrier element 1, in some embodiments, the crushing element 8 can be any element configured to apply a force to the frangible barrier element 1 sufficient to initiate a fracture in the frangible barrier element 1. In some embodiments, the crushing element 8 can be a device similar in configuration to the carrier ring 3, but with a slightly different geometry to induce a load in the frangible barrier element to initiate a fracture, in some embodiments, the crushing element 8 can be located in the downhole direction from the frangible barrier element 1, where the carrier ring is configured to move in a downhole direction when the locking, ring 5 is released. In some embodiments, the crushing element 8 can be located in a topside direction from the frangible barrier element 1, when the carrier ring is configured to move in a topside direction when the locking ring 5 is released. Embodiments of the present invention also include embodiments having multiple crushing elements, located in a topside direction, downhole direction, or both, from the frangible barrier element 1.

In some embodiments, the barrier plug assembly can comprise one or more first sealing elements 12 arranged on the outer surface of the barrier plug assembly 100 for sealing an annulus defined between the barrier plug assembly 100 and the tubing 2. In some embodiments, the barrier plug assembly 100 can comprise one or more second sealing elements 15 that can define the fluid chamber 6. In some embodiments, the one or more second sealing elements 15 can be configured to prevent pressure/fluid leakage between the fluid chamber 6 and the rest of the barrier plug assembly 100.

FIG. 1 shows that the barrier plug assembly 100 that is subject to a pressure P1 13 at the top the barrier plug assembly 100 and a pressure P2 14 below the harrier plug assembly 100. Pressure P1, applied from an uphole side of the barrier plug assembly 100, can be referred as "topside pressure." and the pressure P2, applied from a downhole side of the barrier plug assembly 100 can be referred to as "formation side pressure." In some embodiments, the barrier plug assembly 100 can be pre-installed in the tubing 2 before the tubing 2 in lowered in a subsurface wellbore (not shown) or may be installed in the tubing 2 after the tubing 2 is installed in the subsurface wellbore. In some embodiments, the subsurface wellbore is sealed after the barrier plug assembly 100 is installed in the tithing 2. The is no fluid communication in the wellbore between the region 13 above the barrier plug assembly 101) and the region 14 below the barrier plug assembly 100. To allow fluid communication between the region 13 and 14, the operator must break the at least one frangible barrier element 1 of the barrier plug assembly 100.

In order to open the barrier plug assembly 100, the topside pressure P1 in the tubing 2 may be increased to a value higher than a predetermined opening pressure of the valve 7. The valve 7 may be a burst disc, acoustic or magnetic operated valve systems, or similar. After the predetermined opening pressure of the valve 7 is exceeded, or the conditions for opening valve 7 are met, the valve opens to allow fluid/pressure communication from region 13 into the fluid chamber 6. Pressure in the fluid chamber 6 increases and causes the locking sleeve 5 to move. The locking sleeve 5 may be a piston arranged inside the fluid chamber 6 and may be configured to move as a result of pressure change in the fluid chamber 6, either in an uphole direction, or a downhole direction. The fluid chamber 6 may be an empty chamber or may be filled with a low pressure fluid. In some embodiments, the locking sleeve 5 can be moved or unlocked using a mechanical wireline connection attached to the locking sleeve 5.

The locking sleeve 5 can comprise a recess or a cavity 9. In some embodiments, cavity 9 can have a volume equal to or larger than the second recess or cavity 11 of the carrier ring 3. In some embodiments, the locking sleeve 5 does not have a recess or cavity 9, such as, for example, in embodiments where the locking sleeve moves in an uphole direction in response to a pressure change in fluid chamber 6. In such embodiments, the movement of the locking sleeve 5 in an uphole direction can allow the retaining device 101 to disengage from the first cavity 11 when the locking sleeve 5 moves past the first cavity 11. In other embodiments, the pressure P1 can be increased until the first cavity 9 of the locking sleeve 5 aligns with the second cavity 11 of the carrier ring 3. When the first cavity 9 is aligned with, the second cavity 11, the retaining device 101 is released from the second cavity 11 and into the first cavity 9 of the locking sleeve 5.

In some embodiments, when the locking sleeve 5 has moved a sufficient distance (either uphole or downhole) to release the retaining device 101, the retaining device 101 is no longer able to lock the carrier ring 3 in place. Therefore, the carrier ring 3, together with the frangible barrier element 1, moves towards the crushing element 8 which causes the frangible barrier element 1 to break. In some embodiments, where P1 is greater than P2, the frangible barrier element 1 can move in a downhole direction toward a crushing element 8 located downhole from the frangible barrier element 1. In some embodiments, where P2 is greater than P1, the frangible barrier element 1 can move in a topside direction towards a crushing element 8 located in a topside direction from the frangible barrier element 1.

Figure 4:
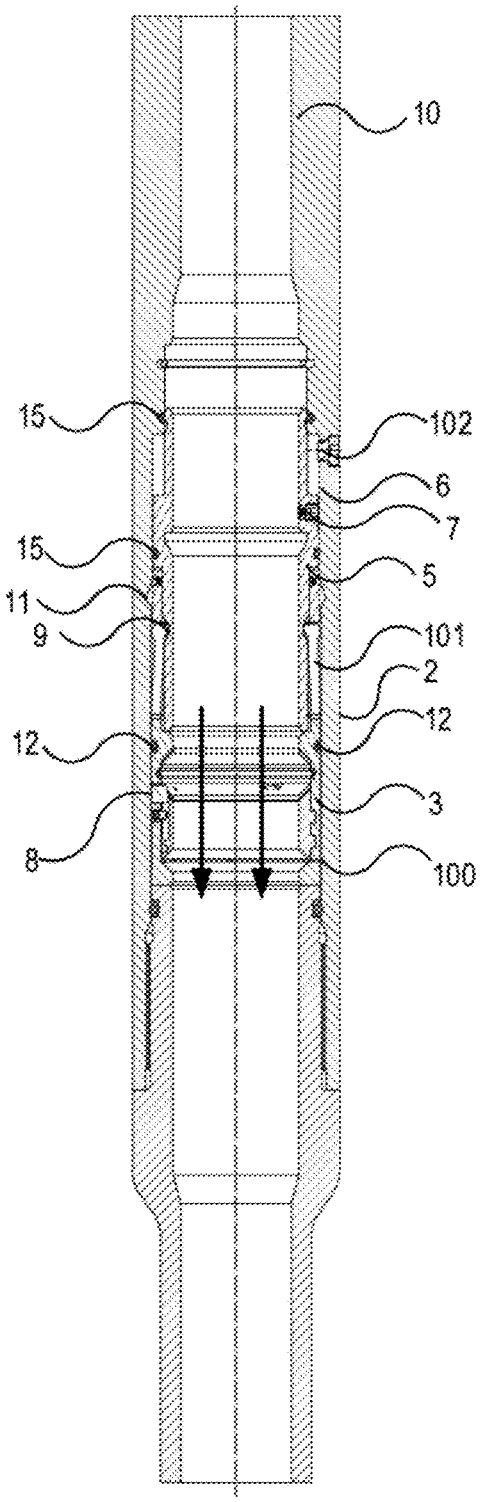
FIG. 4 shows a section view of the barrier plug of FIG. 1 after the frangible barrier element has been shattered, allowing fluid flow through the barrier plug.
Figure 5:
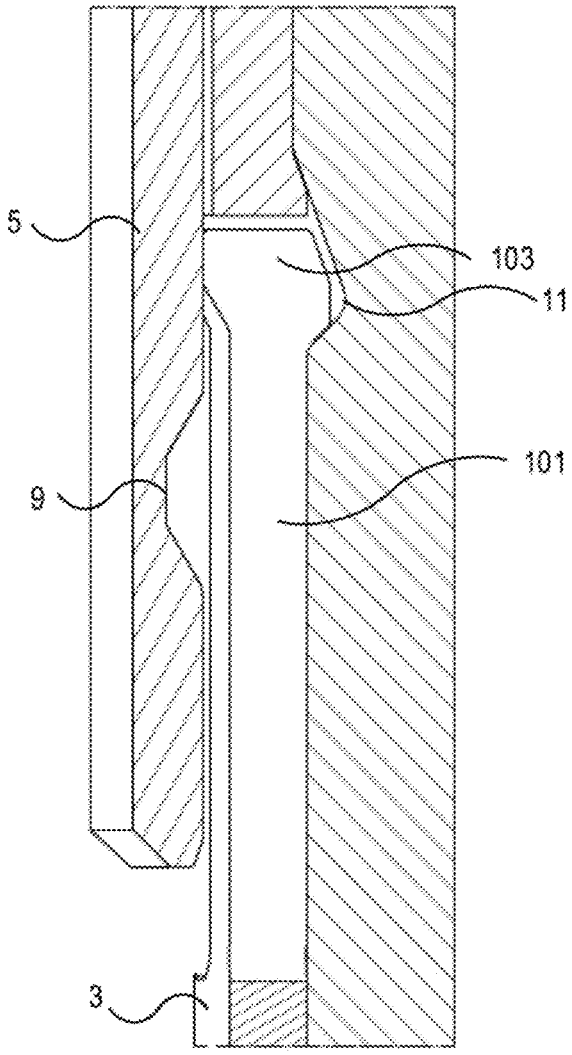
FIG. 5 shows a detailed view of a split finger locking device in accordance with the disclosure.

The movement of the carrier ring 3 towards the crushing element 8 can be caused by the release of the retaining device 101 and the pressure difference between the topside pressure P1 and the formation side pressure P2. The topside pressure P1 should be increased higher than the formation side pressure P2 to allow the movement of the carrier ring 3 towards the crushing element 8. In some embodiments, the crushing element 8 can be studs, spikes, knives or surfaces that are capable of penetrating through the at least one frangible barrier element or causing the frangible barrier element 1 to shatter into small pieces. FIG. 4 depicts a barrier plug assembly 100 after the frangible barrier element 1 has been shattered, depicting a barrier plug assembly 100 that allows fluid to flow through the carrier ring 3. The barrier plug assembly 100 can comprise more than more one retaining device 4 and the locking sleeve 5 and the carrier ring 3 may comprise more than one recess that fit more than one retaining device.

Figure 2:
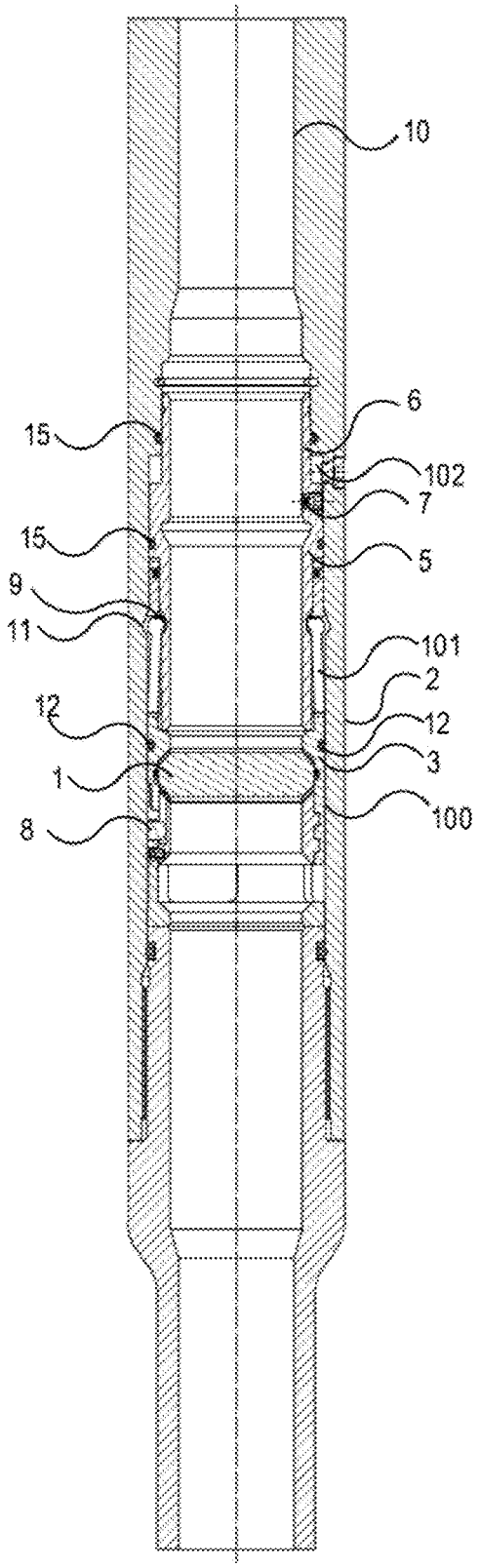
FIG. 2 shows a section view of the barrier plug of FIG. 1 in a closed but unlocked state.
Figure 3:
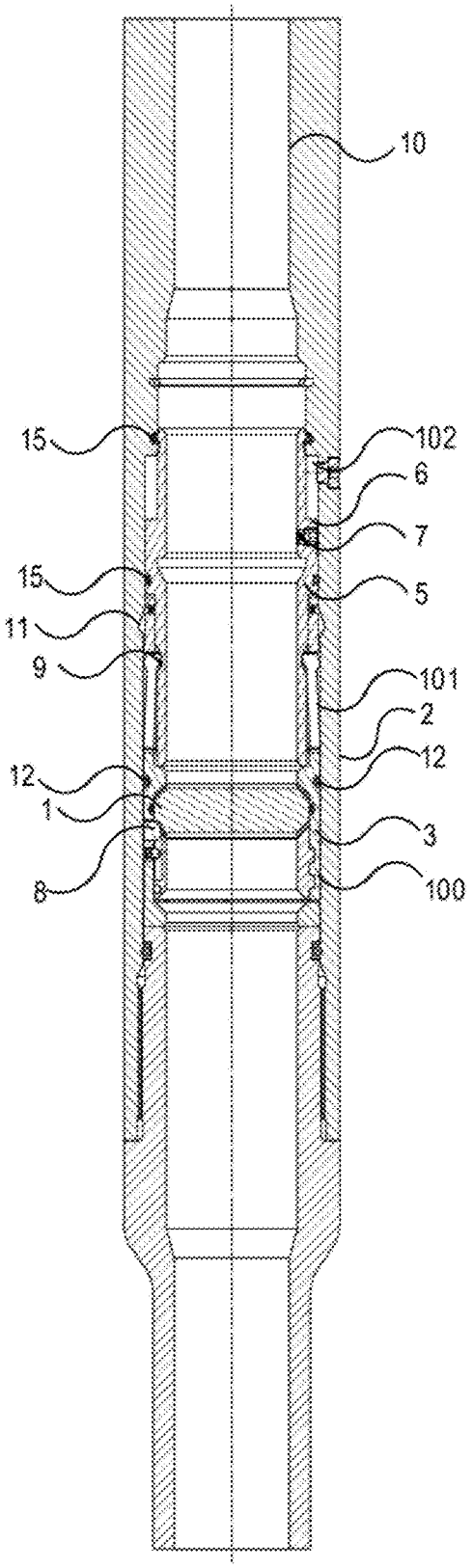
FIG. 3 shows a section view of the barrier plug of FIG. 1 in an open state.

In some embodiments, the retaining device 101 can be one or more split fingers attached to, or cut into to carrier ring 3. For example, FIG. 1 depicts an embodiment where retaining device 101 is a "finger" connected to carrier ring 3. The finger 101 has an upper portion 103 that is shaped such that, when the barrier plug assembly 100 is in a closed and locked position, a part of the upper portion 103 fits in second cavity 11, securing the carrier ring 3 in place. As depicted in FIG. 2, when the first cavity 9 of the locking ring 5 is moved to align with the second cavity 11, the finger 101 can flex around its connection to carrier ring 5, and move into the first cavity 9, unlocking carrier ring 3. As depicted in FIG. 3, once the finger is disposed in first cavity 9 of locking ring 5, the carrier ring 3 is free to slide in a downhole direction, moving the frangible barrier element 1 to crushing element 8.

Figure 6:
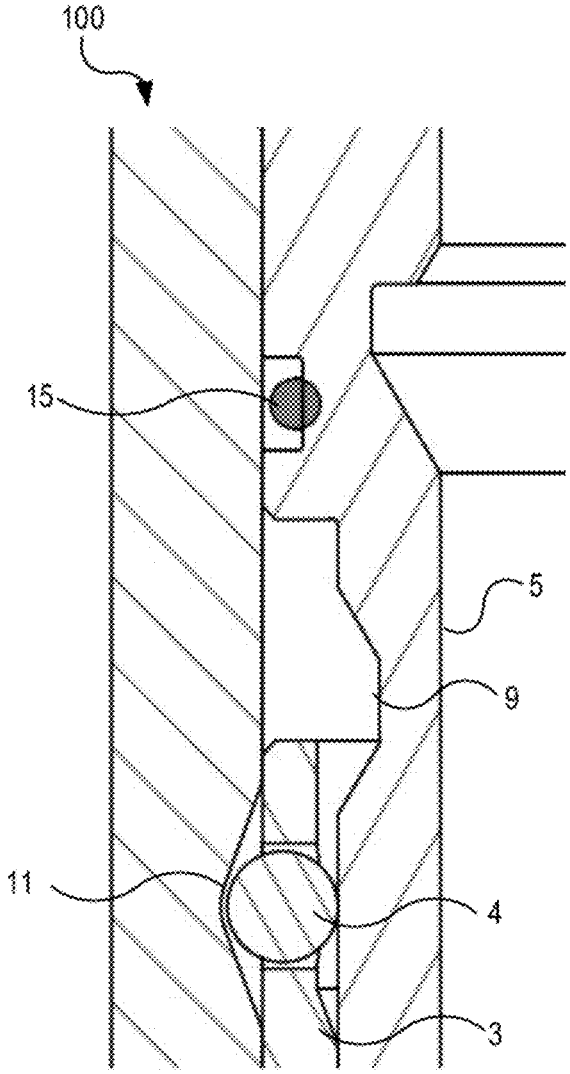
FIG. 6 shows a section view of an embodiment in accordance with the disclosure in a closed and locked state.
Figure 7:
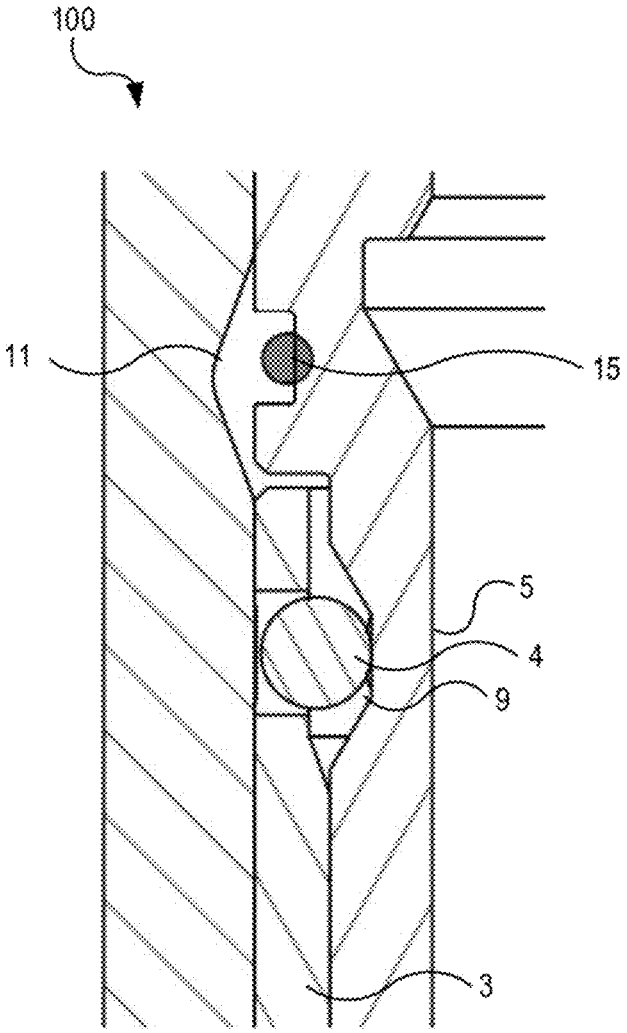
FIG. 7 shows a section view of an embodiment in accordance with the disclosure in an opened state.

In some embodiments, the retaining device can be a ball 4 or a similar object. FIG. 6 depicts another embodiment of a barrier plug assembly 100 using a ball 4 as a retaining device. The details not shown of the embodiment depicted in FIG. 7 are substantially the same as those shown in FIGS. 1-4. In the locked position, the ball 4 is disposed in second cavity 11, securing the carrier ring 3 in place. As depicted in FIG. 7, when the locking ring 5 is moved to align first cavity 9 with second cavity 11, the ball moves into first cavity 9, unlocking the carrier ring 3. In some embodiments, the retaining devices 4 can be sheared apart to unlock the carrier ring due to a shear three applied by locking ring 5. Once the retaining device 4 has moved into the second cavity 11, the carrier ring 3 is free to move in a downhole direction. As with the embodiment shown in FIG. 3, the carrier ring 3 moves the frangible barrier element 1 in a downhole direction until it contacts crushing element 8, shattering the frangible barrier element 1, and allowing fluid to pass through the barrier plug assembly 100. In some embodiments, the locking sleeve 5, the retaining device 4 and carrier ring 3 can all located above the at least one frangible barrier element 1. Having a releasable sleeve that is arranged below the harrier element 1 means that a passage that extends between the topside of the barrier plug assembly 100 (surface side) and the bottom side of the barrier plug assembly 100 (formation side) is needed.

The person skilled in the art realizes that the present invention is not limited to the preferred embodiments described above. The person skilled in the art further realizes that modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A disappearing barrier plug assembly for sealing a subterranean wellbore, the disappearing barrier plug assembly comprising:

a tubular housing having a topside end and a down-hole end, and having a fluid passageway therethrough;

a frangible barrier element disposed in the fluid passageway, such that fluid cannot flow through the fluid passageway while the frangible barrier element is disposed in the fluid passageway, the frangible barrier element disposed on a carrier ring, and comprised of a material that, when subjected to a concentrated force, will break;

a locking sleeve arranged above the carrier ring in the direction of the topside end of the tubular housing, and located in a closed fluid chamber; and a retaining device configured to lock the carrier ring in place when the locking sleeve is in a first position, and configured to unlock the carrier ring when the locking sleeve is in a second position.

2. The barrier plug assembly of claim 1, further comprising a valve arranged on the closed fluid chamber and in pressure communication with the topside pressure, the valve configured to allow or prevent pressure communication between a topside pressure and the fluid chamber.

3. The barrier plug assembly of claim 2, wherein the valve is in fluid communication with the fluid passageway and the fluid chamber.

4. The barrier plug assembly of claim 2, wherein the valve comprises a burst disk.

5. The barrier plug assembly of claim 4, wherein the carrier ring comprises a second cavity for receiving an element of the retaining device, wherein the second cavity has a volume greater than the first cavity.

6. The barrier plug assembly of claim 5, wherein one or more second sealing elements defines the fluid chamber.

7. The method of claim 6, wherein the step of applying a topside pressure comprises opening a valve arranged on the closed fluid chamber and in pressure communication with the tubing, the valve configured to allow or prevent pressure communication between the tubing and the fluid chamber.

8. The method of claim 7, where in releasing the retaining device further comprises:

moving an element of the retaining device from the first cavity in the locking sleeve to a second cavity in the carrier ring.

9. The method of claim 6, further comprising the step of causing the frangible barrier element to contact a crushing element thereby breaking the frangible barrier element.

10. The method of claim 6, wherein the locking sleeve comprises a first cavity which contains an element of the retaining device.

11. The barrier plug assembly of claim 5, wherein the axially moveable locking sleeve is a piston.

12. The barrier plug assembly of claim 1, further comprising a crushing element arranged a distance from the frangible barrier element and configured for crushing the at least one frangible barrier element.

13. The barrier plug assembly of claim 12, wherein the crushing element is arranged a distance in a downhole direction from the frangible barrier element.

14. The barrier plug assembly of claim 1, wherein one or more first sealing elements are arranged on an outer surface of the disappearing barrier plug assembly for sealing an annulus defined between the barrier plug assembly and a tubular enclosure in which the barrier plug is placed.

15. The barrier plug assembly of claim 14, wherein the retaining device is arranged inside the second cavity.

16. The barrier plug assembly of claim 1, wherein one or more second sealing elements defines the closed fluid chamber.

17. The barrier plug assembly of claim 1, where in the locking sleeve comprises a first cavity for receiving an element of the retaining device.

18. The barrier plug assembly of claim 17, wherein the one or more first sealing elements arranged on an outer surface of the disappearing barrier plug assembly for sealing an annulus defined between the disappearing barrier plug assembly and the tubing.

19. A disappearing barrier plug assembly for sealing a subterranean wellbore, the disappearing barrier plug assembly comprising:

at least one frangible barrier element stacked on an axially moveable carrier ring prevented from moving by a retaining device arranged in a first cavity defined by the carrier ring;

an axially moveable locking sleeve arranged above the carrier ring and located inside a closed fluid chamber comprising a valve having a predetermined opening pressure that when exceeded the valve allows pressure from tubing into the fluid chamber, wherein the locking sleeve comprises a second cavity that, when aligned with the first cavity, the retaining device is released from the second cavity whereby the axially moveable carrier ring and the at least one frangible barrier element are permitted to move towards a crushing element arranged below the one frangible barrier element and configured to disintegrate the at least one frangible barrier element.

20. A method for opening a disappearing barrier plug assembly for sealing a subterranean wellbore, the method comprising:

providing a disappearing barrier plug assembly comprising a tubular housing having a topside end and a down-hole end, and having a fluid passageway therethrough;

a frangible barrier element disposed in the fluid passageway, such that fluid cannot flow through the fluid passageway while the frangible barrier element is disposed in the fluid passageway, the frangible barrier element disposed on a carrier ring, and comprised of a material that, when subjected to a concentrated force, will break;

a locking sleeve arranged above the carrier ring in the direction of the topside end of the tubular housing, and located in a closed fluid chamber; and a retaining device configured to lock the carrier ring in place when the locking sleeve is in a first position, and configured to unlock the carrier ring when the locking sleeve is in a second position, creating an opening in the closed fluid chamber, applying a topside pressure to the tubular housing that passes into the closed fluid chamber, moving the locking sleeve into the second position releasing the retaining device, causing the frangible barrier element to move.

21. The method of claim 20, wherein the step of moving the locking sleeve into an open position that releases the retaining device further comprises moving the locking sleeve in an uphole direction.

* * * * *